US008874010B2

(12) United States Patent
Wada

(10) Patent No.: US 8,874,010 B2
(45) Date of Patent: Oct. 28, 2014

(54) TONER CONTAINER, DEVELOPING APPARATUS, PROCESS CARTRIDGE, AND IMAGE FORMING APPARATUS

(75) Inventor: Koji Wada, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/337,893

(22) Filed: Dec. 27, 2011

(65) Prior Publication Data

US 2012/0163876 A1 Jun. 28, 2012

(30) Foreign Application Priority Data

Dec. 28, 2010 (JP) ..... 2010-291708
Nov. 15, 2011 (JP) ..... 2011-249456

(51) Int. Cl.
*G03G 15/08* (2006.01)

(52) U.S. Cl.
CPC .... *G03G 15/0896* (2013.01); *G03G 2215/0802* (2013.01); *G03G 15/0822* (2013.01)
USPC ..... 399/258; 399/261

(58) Field of Classification Search
None
See application file for complete search history.

(56) References Cited

U.S. PATENT DOCUMENTS 7,899,369 B2 * 3/2011 Kurogawa ..... 399/258

FOREIGN PATENT DOCUMENTS

JP 4-178671 A 6/1992
JP H04-178671 A * 6/1992 ..... G03G 15/08
JP 2001-356577 A * 12/2001 ..... G03G 15/08

* cited by examiner

*Primary Examiner* — Clayton E LaBalle
*Assistant Examiner* — Jas Sanghera
(74) *Attorney, Agent, or Firm* — Fitzpatrick, Cella Harper & Scinto

(57) ABSTRACT

A toner container for accommodating toner, includes a first opening through which the toner is passable; a toner feeding member for feeding the toner to the first opening by reciprocating motion toward and away from the first opening; an urging member for urging the toner feeding member; a movable member movable between a position for moving the toner feeding member against an urging force of the urging member and a position for permitting the toner feeding member to move by the urging force of the urging member; a second opening for permitting the urging member and the toner feeding member to pass into the toner container to install them in the toner container; and a cap for closing the second opening.

16 Claims, 10 Drawing Sheets

(a)

(b)

(c)

(a)

(b)

(c)

TONER CONTAINER, DEVELOPING APPARATUS, PROCESS CARTRIDGE, AND IMAGE FORMING APPARATUS

FIELD OF THE INVENTION AND RELATED ART

The present invention relates to a toner container, a developing apparatus (device), and a process cartridge, which are employed by an image forming apparatus such as a facsimile machine, a printer, etc.

In recent years, image forming apparatuses have been significantly reduced in size. Thus, it has become necessary to significantly reduce a process cartridge in thickness. This reduction in the thickness of a process cartridge has created various problems. One of the problems is how to create a toner container thin enough to be suitable for a process cartridge which is significantly thinner than a conventional process cartridge. More specifically, conventionally, the toner in a toner container is conveyed, white being stirred, by the rotational stirring (conveying) member in the container. Thus, the container size is closely related to the radius of the circular sweeping range of the stirring member. Therefore, it has been rather difficult to reduce in thickness a toner container in thickness. One of the solutions to this problem is disclosed in Japanese Laid-open Patent Application H04-178671. In the case of the process cartridge disclosed in this patent application, its toner container is not provided with a rotational toner conveying (stirring) member. Instead, it is provided with a toner conveying member which is in the form of a piece of thin plate and is reciprocally moved in the direction in which the toner in the toner container is to be conveyed. Thus, this process cartridge is significantly thinner than any of the process cartridges in accordance with the prior art.

Referring to FIG. 11, which is a sectional view of the developing device disclose in Japanese Laid-open Patent Application H04-178671, the toner container 211 is in the form of a long and thin parallelepiped, being therefore significantly thinner compared to a conventional toner container. It has an opening 211*c* (first opening), which is next to a development roller 217. It has also a stirring member 219 and a toner conveying member 213. The toner stirring member 219 is on the immediately inward side of the first opening 211*c*, and is significantly smaller in the radius of its sweeping range than a conventional stirring member. The toner conveying member 213 is thin and long, being roughly rectangular. Its lengthwise edges are parallel to the lengthwise direction of the cartridge, and its widthwise edges are parallel to the widthwise direction of the cartridge.

The downstream end of the toner conveying member 213 in terms of the toner conveyance direction is provided with a pair of elongated holes, and is supported by the stirring member 219 which is rotationally driven. There are a pair of compression springs 214 (pressure applying member) between the other end of the toner conveying member 213 and the rear wall of the toner container 211.

The stirring member 219 is fitted with a sector gear (unshown). As driving force is transmitted to the sector gear from an external power source, the stirring member 219 is rotated in the direction indicated by an arrow mark U in FIG. 11. More specifically, while the driving force is transmitted to the sector gear, the toner conveying member 213 is moved in the direction to compress the compression springs 214 (direction indicated by arrow mark V). Then, as the transmission of the driving force to the sector gear stops, the toner conveying member 213 is moved by the compression springs 214 in the direction to release the pressure stored in the springs 214.

The art disclosed in Japanese Laid-open Patent Application H04-178671 can provide a toner container 211 which is significantly thinner than a conventional toner container. However, when it is assembled, the toner conveying member 213, compression springs 214, and stirring member 219 have to be installed in the toner container 211 through the first opening 211*c*, which is very narrow. In other words, the toner container 211 is rather difficult to assemble.

SUMMARY OF THE INVENTION

Thus, the primary object of the present invention is to provide a developing apparatus (device) which is significantly thinner and easier to assemble than a conventional developing apparatus (device), and an image forming apparatus having such a developing apparatus (device).

A toner container for accommodating toner, includes a first opening through which the toner is passable; a toner feeding member for feeding the toner to the first opening by reciprocating motion toward and away from the first opening; an urging member for urging the toner feeding member; a movable member movable between a position for moving the toner feeding member against an urging force of the urging member and a position for permitting the toner feeding member to move by the urging force of the urging member; a second opening for permitting the urging member and the toner feeding member to pass into the toner container to install them in the toner container; and a cap for closing the second opening.

According to the present invention, it is possible to provide a toner container which is significantly thinner than a conventional toner container, and has an opening (second opening) through which its toner conveying member and pressure applying member(s) are installable in the container, being therefore significantly easier to assemble than a conventional toner container.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 4(*b*) is an enlarged view of the top half of the portion of FIG. 4(*a*) circled by the left circle in the drawing, and FIG. 4(*c*) is an enlarged view of the top half of the portion of FIG. 4(*a*) circled by the right circle in the drawing.

DESCRIPTION OF THE PREFERRED EMBODIMENTS

Embodiment 1

Figure 2:
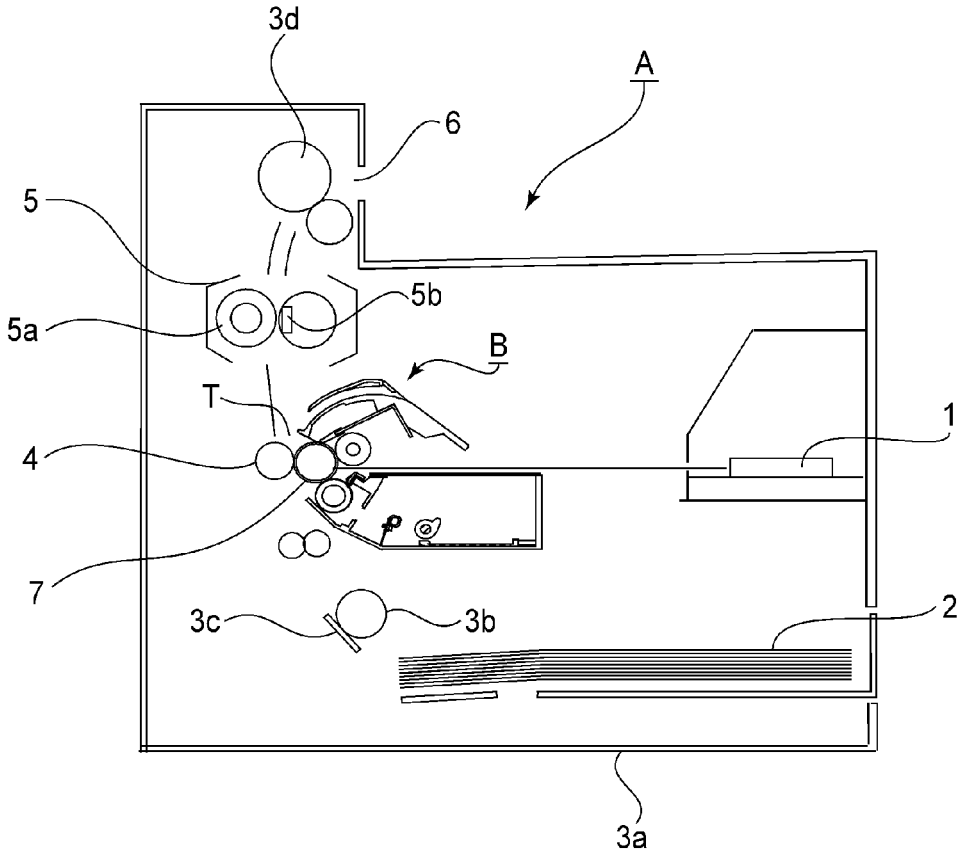
FIG. 2 is a schematic sectional view of the image forming apparatus in the first embodiment of the present invention, and shows the general structure of the apparatus.
Figure 3:
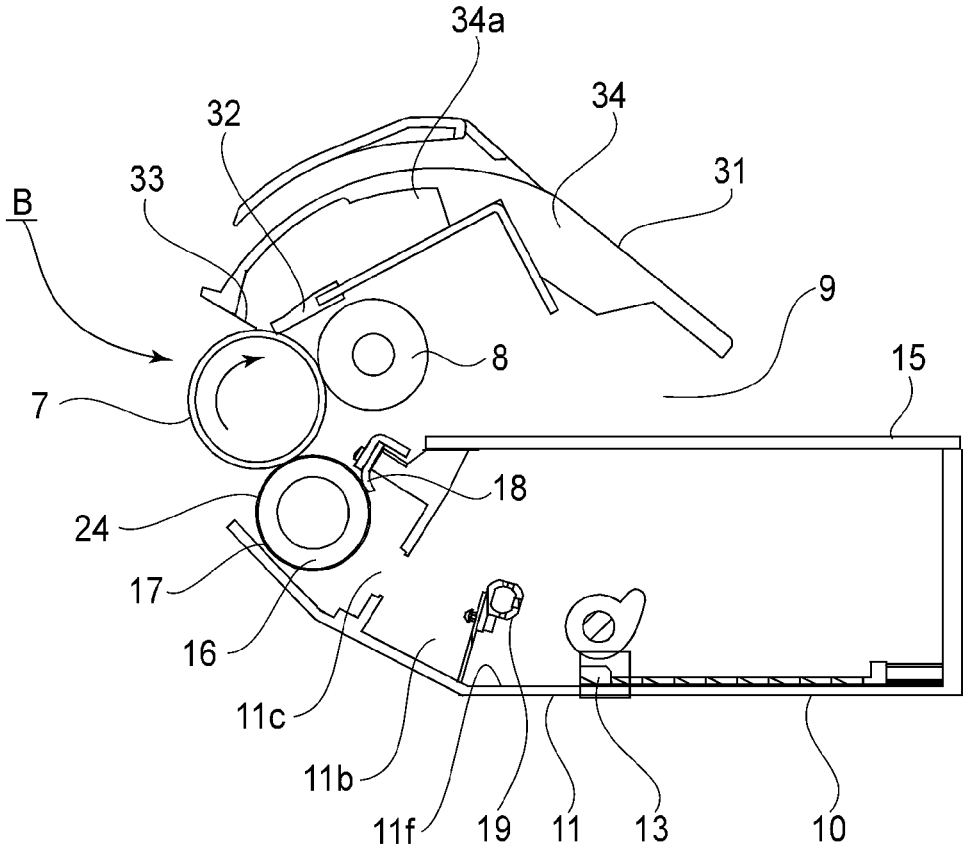
FIG. 3 is a schematic sectional view of the process cartridge in the first embodiment of the present invention, and shows the general structure of the cartridge.

First, referring to FIGS. 2 and 3, the developing device and image forming apparatus in the first preferred embodiment of the present invention are described. FIG. 2 is a schematic sectional view of the image forming apparatus A in the first embodiment of the present invention. It shows the general structure of the apparatus A. FIG. 3 is a schematic sectional view of the process cartridge B in the first embodiment. It shows the general structure of the cartridge B.

The image forming operation of the apparatus A is as follows: Referring to FIGS. 2 and 3, a photosensitive drum 7, that is, an image bearing member in the form of a drum, is charged by a charge roller 8 across its peripheral surface. Then, the charged portion of the peripheral surface of the photosensitive drum 7 is scanned by (exposed to) the beam of laser light projected, while being modulated with the image formation signals, upon the peripheral surface of the drum 7 from an optical system 1, through the exposure opening 9 of the cartridge. As a result, an electrostatic latent image is effected on the peripheral surface of the photosensitive drum 7. This electrostatic latent image is developed by the developing device 10 into a visible image, that is, an image formed of toner, with the use of the toner in the developing device 10.

Meanwhile, the sheets 2 of recording medium stored in layers in a cassette 3*a* are fed one by one, while being separated from the rest, into the main assembly of the image forming apparatus A, by the pickup roller 3*b* and sheet separating member 3*c*. Then, each sheet 2 is conveyed to the nip T (transfer station) between the photosensitive drum 7 in the process cartridge B and the transfer roller 4 (transferring means) of the apparatus main assembly. Then, the sheet 2 is conveyed through the nip T. While the sheet 2 is conveyed through the nip T, the toner image formed on the peripheral surface of the photosensitive drum 7 is transferred onto the sheet 2. Then, the sheet 2 is conveyed to the fixing device 5.

Then, the sheet 2 is conveyed through the fixing device 5. While the sheet 2 is conveyed through the fixing device 5, the sheet 2 and the toner image thereon are subjected to heat and pressure by a combination of the driver roller 5*a* and heater 5*b* of the fixing device 5. As a result, the toner image is fixed to the sheet 2. After the fixation of the tone image, the sheet 2 is discharged from the main assembly of the image forming apparatus A by a pair of discharge rollers 3*d* through the print outlet 6. As for the toner remaining on the peripheral surface of the photosensitive drum 7 after the transfer, it is scraped down from the photosensitive drum 7 by a cleaning blade 32, is scooped up by a scooping sheet 33, and then, is recovered into the residual toner storage 34*a*.

(Process Cartridge B)

Next, referring to FIG. 3, the process cartridge B has a cleaning device 31 and the developing device 10. The cleaning device 31 has a drum supporting frame 34, which rotatably supports the photosensitive drum 7. The aforementioned cleaning blade 32 and charge roller 8 are in this drum supporting frame 34 and are attached to the drum supporting frame 34.

The developing device 10 has a toner container 11, which has a toner chamber 11*b*. The development roller 17 which the process cartridge B has is attached to the frame of the toner container 11. The developing device 10 is rotatably supported by the drum supporting frame 34. The lengthwise ends of the development roller 17 are fitted with a pair of spacer rings 24 (gap regulation members), one for one, which keep the development roller 17 parallel to the photosensitive drum 7 with the presence of a preset amount of gap between the roller 17 and drum 7.

(Developing Device 10)

Figure 4:
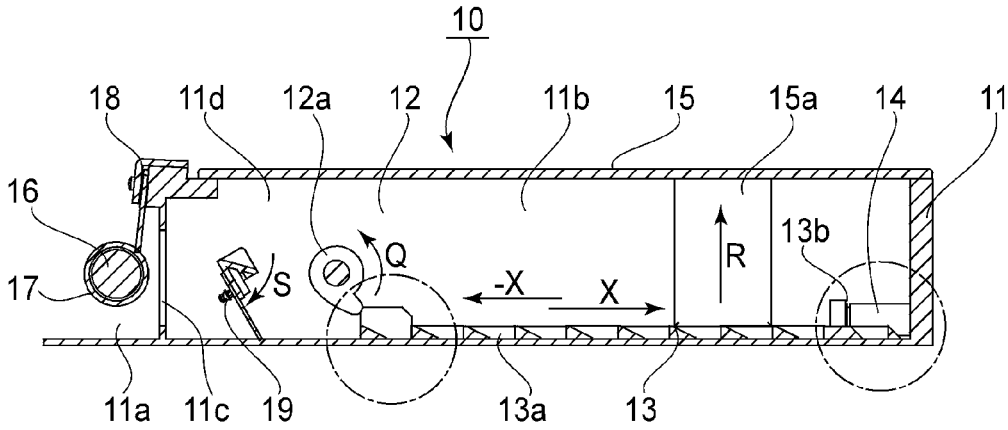
FIG. 4(*a*) is a schematic sectional view of the developing device in the first embodiment of the present invention, and shows the general structure of the device.
Figure 4:
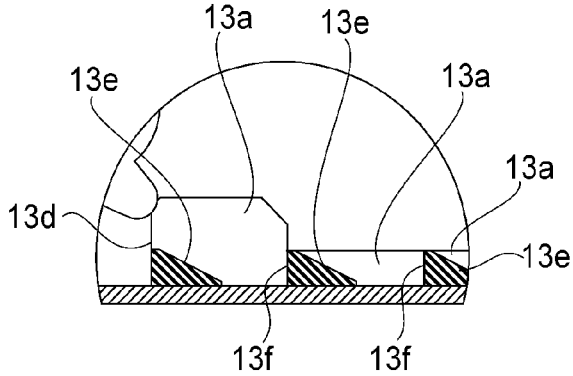
Figure 4:
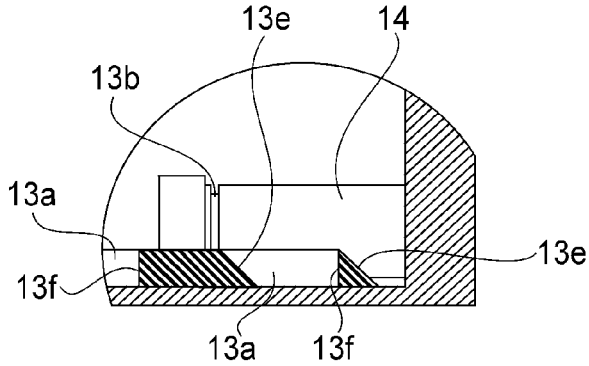

Next, referring to FIG. 4(*a*) which is a schematic sectional view of the developing device 10 in this embodiment and shows the general structure of the device, the developing device 10 comprises the toner container 11, a toner container lid 15, a stationary magnet 16, the development roller 17, a development blade 18, a development roller gear 22, and a stirring member gear 23.

The toner container 11 has a development chamber 11*a*, the toner chamber lib, the first opening 11*c*, and a second opening 11*d*. The development chamber 11*a* and toner chamber lib are separated from each other by the first opening 11*c*. There are a rotational member 12, the toner conveying member 13, the pair of compression springs 14 (pressure applying members), and a toner stirring member 19 in the toner chamber lib.

The second opening 11*d* is the opening through which the toner conveying member 13, toner stirring member 19, and rotational member 12 can be placed in the toner chamber 11*b*. The second opening 11*d* is kept covered by the toner container lid 15.

The toner in the toner chamber 11*b* is conveyed to the adjacencies (development roller side) of the development roller 17 by the reciprocal movement of the toner conveying member 13. Then, the toner stirring member 19 conveys the toner to the development roller 17 in the development chamber 11*a* through the first opening 11*c* by being rotated. There is the stationary magnet 16 in the hollow of the development roller 17. Thus, as the development roller 17 is rotated, the toner in the adjacencies of the development roller 17 is borne on the peripheral surface of the development roller 17, and is formed by a development blade 18, into a layer of toner which is uniform in thickness, while being frictionally charged by the blade 18. Then, the toner particles in the toner layer on the peripheral surface of the development roller 17 transfer onto the peripheral surface of the photosensitive drum 7, in the pattern of the electrostatic latent image on the peripheral surface of the photosensitive drum 7, forming thereby a visible on the peripheral surface of the photosensitive drum 7, of the toner, in the pattern of the electrostatic latent image.

The toner conveying member 13 is in contact with the bottom surface 11*f* of the toner chamber 11*b*, and conveys the toner by being reciprocally moved in contact with the bottom surface 11*f*. Thus, the portion of the bottom surface 11*f* of the toner chamber 11*b*, which is in contact with the toner conveying member 13, is flat, smooth, and parallel to the bottom surface of the toner conveying member 13. That is, the toner conveying member 13 is reciprocally slidable on the bottom surface 11*f* of the toner chamber 11*b*.

Figure 5:
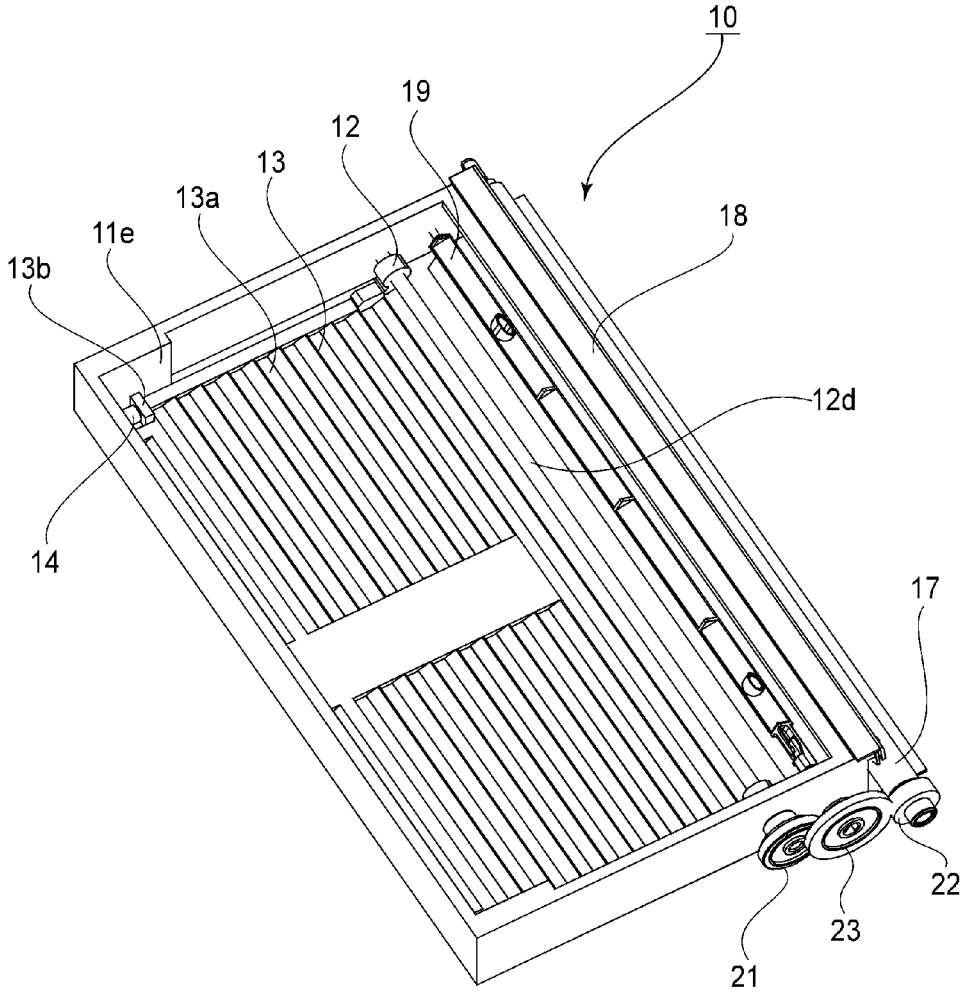
FIG. 5 is a perspective view of the developing device (minus its top lid) in the first embodiment of the present invention.

Next, referring to FIG. 5 which is a perspective view of the developing device 10 (minus its top cover) in this embodiment, there are the development roller 17, development blade 18, and development roller gear 22 in the development chamber 11*a*. The development blade 18 is solidly attached to the frame of the toner container 11 with the use of small screws (unshown). The toner stirring member 19 is rotatably attached to the frame of the toner container 11, like the rotational member 12. The toner stirring member gear 23 is solidly attached to the shaft of the toner stirring member 19. The toner stirring member 19 (which hereafter may be referred to simply as stirring member 19) is rotated in the direction indicated by an arrow mark S in FIG. 4(*a*).

The development roller gear 22 is in mesh with the photosensitive drum gear (unshown). Thus, the rotational driving force is transmitted from the main assembly of the image forming apparatus to the development roller gear 22 by way of the photosensitive drum gear (unshown). Further, the development roller gear 22 rotates the stirring member 19 by way of the stirring member gear 23. It rotates the rotational member 12 by way of the rotational member gear 21.

Referring again to FIG. 4(*a*), the rotational member 12 is rotatably supported by the frame of the toner container 11, and is fitted with a pair of cams 12*a*. More specifically, each cam 12*a* is solidly attached to the shaft 12*d* of the rotational member 12 with the use of an elastic pin or the like. Thus, as the rotational member 12 is rotated in the direction indicated by an arrow mark Q, the cams 12*a* rotate in the direction of the arrow mark Q, while intermittently pressing the toner conveying member 13 in the direction indicated by an arrow mark X. Further, the developing device 10 is provided with a pair of compression springs 14 which are between the toner conveying member 13 and the frame of the toner container 11, and the toner conveying member 13 is kept pressured toward the development roller 17 (direction indicated by arrow mark X) by the compression springs 14. Therefore, as the rotational member 12 is rotated, the toner conveying member 13 is made to intermittently and reciprocally (direction indicated by arrow mark −X or direction indicated by arrow mark X) move by the combination of the cams 12 and compression springs 14. That is, the rotational member 12 is a rotatable member, and is capable of being in the state in which it presses the toner conveying member 13 in the direction indicated by the arrow mark X against the resiliency of the compression springs 14, and in the state in which it allow the toner conveying member 13 to be moved in the direction indicated by the arrow mark −X by the resiliency of the compression spring 14.

Next, referring to FIG. 5, each of the lengthwise end walls of the toner container 11 is provided with a toner conveying member regulating portion 11*e*, which is for regulating the movement of the toner conveying member 13 in terms of the lengthwise direction of the toner container 11, that is, the direction (indicated by arrow mark X) perpendicular to the direction in which the compression spring 14 presses on the toner conveying member 13. Each toner conveying member regulating portion 11*e* protrudes inward of the toner container 11 by a preset distance from the inward surface of the corresponding lengthwise end wall of the toner container 11. It regulates the toner conveying member 13 in terms of the movement of the toner conveying member 13 in the lengthwise direction of the toner container 11. The developing device 10 is provided with two compression springs 14 which are at the lengthwise ends of the toner container 11 one for one. Therefore, the toner conveying member 13 is kept stable in attitude while remaining under the pressure from the compression springs 14. Referring again to FIG. 4(*a*), the top lid 15 of the toner container 11 has a pair of toner conveying member regulating portions 15*a*, which project inward of the container 11. The regulating portions 15*a* prevent the toner conveying member 13 from becoming afloat from the bottom wall 11*f* of the toner container 11, in the direction perpendicular to the lengthwise direction of the member 13 and the direction in which the member 13 is kept pressed by the compression springs 14. That is, the toner conveying member regulating portions 15*a* prevent the toner conveying member 13 from separating from the bottom surface 11*f* of the toner container 11, that is, the surface with which the toner conveying member 13 is required to remain in contact. Designing the toner container 11 so that the toner conveying member regulating member 15*a* is an integral part of the toner container lid 15 makes it possible to integrate the process of attaching the toner container lid 15 to the main structure of the toner container 11, with the process of properly positioning the toner conveying member 13 in the toner container 11, making it easier to assembly the toner container 11.

Next, referring to FIG. 4(*b*) which is an enlarged view of the top half of the portion of FIG. 14(*a*) surrounded by the circle on the development roller side of the drawing, the toner conveying member 13 is provided with a pair of projections 13*d*, which are perpendicular to the bottom surface 11*f* of the toner chamber 11*b* after the installation of the toner conveying member 13 into the toner container 11. The projections 13*d* are positioned so that after the installation of the toner conveying member 13, they will be in the adjacencies of the development roller 17, and will be at the lengthwise ends of the toner conveying member 13, one for one.

Next, referring to FIG. 4(*c*) which is an enlarged view of the top half of the portion of FIG. 4(*a*) surrounded by the circle on the compression spring side, the toner conveying member 13 is made up of an external frame, and multiple parallel slats connected to the lengthwise ends of the frame, being thereby provided with multiple holes 13*a*, which are trapezoidal in cross-section at a plane perpendicular to the lengthwise direction of the member 13. The holes 13*a* are wider at the top than at the bottom in terms of the widthwise direction of the member 13. Each hole 13*a* functions as a portion in which the toner conveying member 13 holds toner. Further, each slat, that is, the portion of the toner conveying member 13, which is between the adjacent two holes 13*a* of the member 13, is also trapezoidal in cross-section at a plane parallel to the lengthwise direction of the member 13. It has a surface 13*e* and a surface 13*f*. The surface 13*e* faces toward the compression springs 14 and is acutely angled relative to the moving direction of the toner conveying member 13 toward the compression springs 14, whereas the surface 13*f* faces toward the development roller 17 (first opening 11*c*) and is roughly perpendicular to the bottom surface 11*f* of the toner chamber 11*b*. In other words, each hole 13*a* is between the slanted surface 13*e* of a slat of the toner conveying member 13, and the roughly vertical surface 13*f* of the next slat.

Providing the toner conveying member 13 with multiple holes 13*a* as described above makes it easier for the toner conveying member 13 to convey toner. More concretely, as the toner conveying member 13 is moved in the direction indicated by the arrow mark −X (toward first opening 11*c*), the toner held in each hole 13*a* is conveyed (moved) in the direction of the arrow mark −X by the toner conveyance surface 13*f*, whereas as the member 13 is moved in the direction of the arrow mark X (away from first opening 11*c*), the toner in each hole 13*a* is made to slide over the slat of the toner conveying member 13 between the adjacent two holes 13*a*, following the slanted surface 13*e*, by the movement of the member 13. That is, as the toner conveying member 13 is moved in the direction of the arrow mark X, the toner in a given hole 13*a* of the member 13 is made to move into the adjacent upstream hole 13*a* in terms of the movement of the member 13 in the direction of the arrow mark X.

The compression springs 14 are not to interfere with the toner conveyance. Therefore, they are positioned on the inward side of the toner conveyance member 13 as seen from the first opening side of the toner container 11. Further, the compression springs 14 are to remain anchored, and it is only in the widthwise direction of the toner conveying member 13 (X direction or −X direction) that the compression springs 14 are to be allowed to expand, or compress. Thus, each compression spring 14 is anchored to the rib 13*b* (spring anchor) of the toner conveying member 13; one end of the compression spring 14 is fitted around the rib 13*b*.

(Movement of Toner Conveying Member 13)

Figure 6:
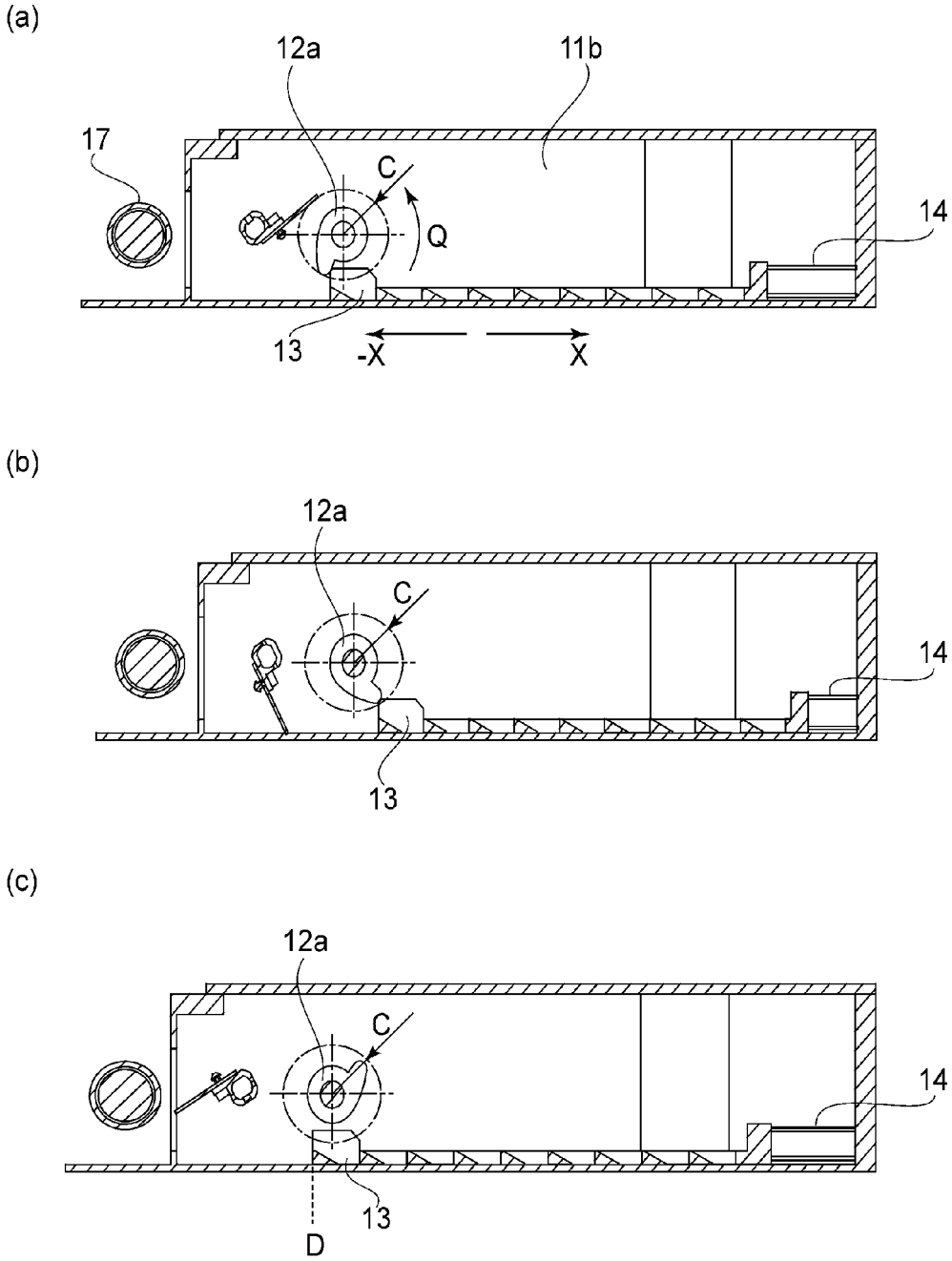
FIG. 6 is a drawing for describing the movement of the toner conveying member in the first embodiment.
Figure 7:
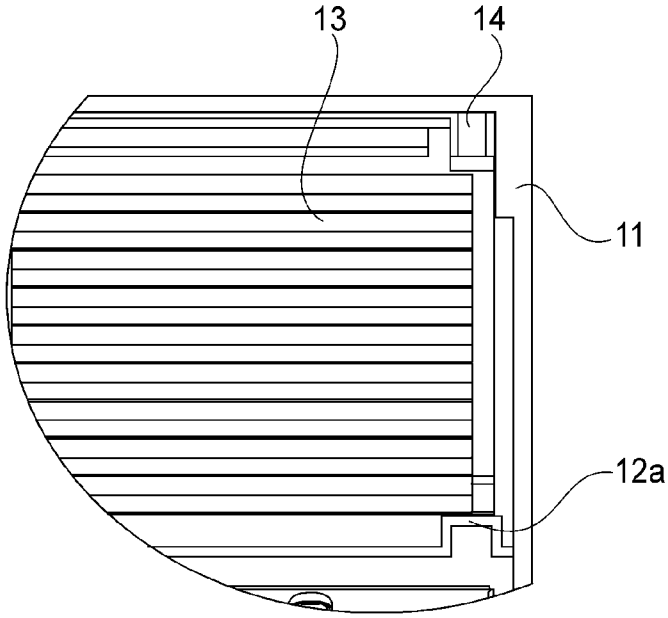
FIG. 7 is a partial plan view of the rotational member different in shape from the one in the first embodiment.

Referring to FIG. 6(*a*), as the rotational member 12 is rotated in the direction indicated by an arrow mark Q, the toner conveying member 13 is pressed in the X direction by the cams 12*a* of the rotational member 12. Thus, the toner conveying member 13 moves in the X direction while following the bottom surface 11*f* of the toner chamber 11*b*, and compressing the compression springs 14 in the X direction. Consequently, a force which works in the direction to press the toner conveying member 13 in the −X direction is stored in the compression springs 14 as shown in FIG. 6(*b*).

Next, referring to FIG. 6(*c*), as the cam 12*a* is rotated further by the further rotation of the rotational member 12, the amount of force applied to the toner conveying member 13 by the cams 12*a* reduces, being thereby overwhelmed by the resiliency of the compression springs 14. Thus, the toner conveying member 13 is swiftly moved in the −X direction by the resiliency of the compression springs 14 until the compression springs 14 extend as far as they can.

A point D at which the downstream edge of the toner conveying member 13, in terms of the direction in which the compression springs 14 expand, is when the compression springs 14 have extended as far as they are allowed is within the sweeping range C of the cams 12*a*. It is also the point at which the cams 12*a* begin to push the toner conveying member 13 in the X direction as they continue to rotate. Then, as the rotational phase of the cams 12*a* become such that the cams 12*a* can press the toner conveying member 13, the toner conveying member 13 begins to be pressed again by the cams 12*a*, being thereby moved in the direction of the arrow mark X (state shown in FIG. 6(*a*)).

Thus, as the rotational member 12 is rotated, the toner conveying member 13 is reciprocally moved, whereby the toner is moved to the adjacencies of the toner stirring member 19. That is, the developing device 10 is structured so that for each full rotation of the rotational member 12 (cams 12*a*), the cams 12*a* are in the state in which they are in contact with the toner conveying member 13 and press the toner conveying member 13, or in the state in which they are not in contact with the toner conveying member 13 and do not press the toner conveying member 13. The state in which the cams 12*a* are in contact with the toner conveying member 13 and press the toner conveying member 13 is equivalent to the state of the developing device 10 shown in FIGS. 6(*a*) and 6(*b*), whereas the state in which cams 12*a* are not in contact with the toner conveying member 13 and do not press the toner conveying member 13 is equivalent to the state of the developing device 10 shown in FIG. 6(*c*). Regarding the speed at which the toner conveying member 13 is reciprocally moved, the speed at which the toner conveying member 13 is moved (rearward) by the pressure applied by the cams 12*a* of the rotational member 12 is different from the speed at which toner conveying member 13 is moved (forward) by the resiliency of the compression springs 14. Therefore, the amount by which the toner is conveyed can be adjusted by adjusting the compression springs 14 in the amount of resiliency, instead of substantially changing the amount of torque applied to rotate the rotational member 12.

(Assembly of Developing Device 10)

Figure 1:
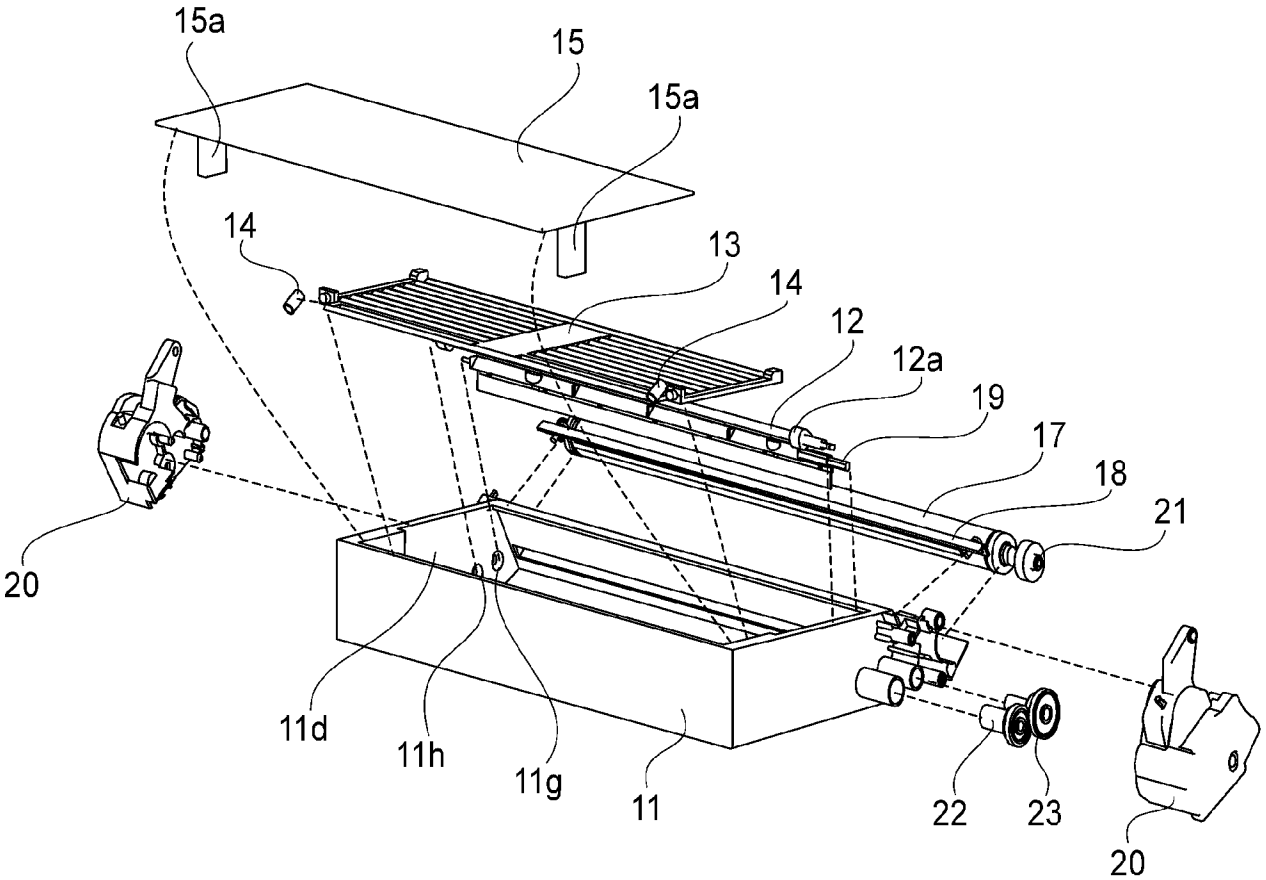
FIG. 1 is an exploded perspective view of the developing device in the first embodiment of the present invention.

FIG. 1 is an exploded perspective view of the developing device 10 in this embodiment. It shows how the developing device 10 is to be assembled. Referring to FIG. 1, first, the rotational member 12 and toner stirring member 19 are to be placed in the toner container 11 through the second opening 11*d*. During the placement of these components 12 and 19, the rotational member 12 is to be in such a rotational phase that its cams 12*a* do not press the toner conveying member 13, and the toner stirring member 19 is to be kept tilted. Further, the stirring member 19 is to be inserted so that its leading end, in terms of the stirring member insertion direction, fits into a first hole 11*g*, with which the lengthwise end wall of the developing device frame (toner container frame) on the opposite side from the side from which the developing device 10 is driven, is provided. Incidentally, in order to make it easier for the stirring member 19 to be inserted into the first hole 11*g*, the first hole 11*g* is chamfered on the side from which the stirring member 19 is inserted. In terms of the direction parallel to the axial line of the development roller 17 (lengthwise direction of toner container 11), the side from which the developing device 10 is not driven means the opposite side of the developing device 10 from the side where the development roller gear 22 (FIG. 4) is attached. Thus, the lengthwise end of the toner container 11, to which the development roller gear 22 (for development roller 17) is attached, is referred to as the "driving side", and the opposite side of the toner container 11 from the "driving side" may be referred to as non-drive side".

Next, the toner stirring member gear 23 is to be inserted into the toner container 11 from the "driving side". The rotational member 12 also is to be inserted, while being kept tilted, into the toner container 11 through the second opening 11*d* as is the toner conveying member 13, so that its leading end, in terms of its insertion direction, fits into a second hole 11*h*, with which the lengthwise end wall of the toner container 11 on the "non-drive side" is provided. Then, the rotational member gear 21 is to be inserted into the second hole 11*h* to solidly fit the gear 21 around the lengthwise end of the rotational member 12 so that the gear 21 does not slip relative to the rotational member 12 in terms of their rotational direction.

Next, the compression springs 14 are to be attached to the toner conveying member 13. More specifically, in terms of the lengthwise direction of the toner container 11, the compression springs 14 are to be attached to the read end of the toner conveying member 13 as seen from where the development roller 17 will be after the completion of the developing device 10. Further, in terms of the widthwise direction of the toner container, one of the compression springs 14 is attached to one end, and the other is attached to the other end. After the attachment of the compression springs 14, the toner conveying member 13 is to be inserted into the toner chamber 11*b* through the second opening 11*d*, in such a manner that after the insertion of the toner conveying member 13, the toner conveying member 13 is in contact with the compression springs 14 and the compression springs 14 are in contact with the rear wall of the toner container 11.

Next, the development blade 18 is to be attached to toner container 11 with the use of small screws, and then, the development roller 17 is to be placed in the development chamber 11*a*. Then, a pair of development roller holder 20 are to be attached to the "driving side" end and "non-drive side" ends of the toner container 11, one for one, so that the rotational member 12, development roller 17, and toner stirring member 19 are accurately positioned in terms of the lengthwise direction of the developing device (toner container 11).

After the attachment of all the components of the developing device 10 except for the toner container lid 15, the toner container 11 is to be filled with toner through the second opening 11*d*. Next, the toner container 11 is to be fitted with the toner container lid 15 so that the second opening 11*d* of the container 11 is covered with the lid 15. Lastly, the lid 15 is to be welded to the toner container 11 to complete the developing device 10.

Because the toner conveying member 13 is to be positioned between the pair of compression springs 14 and the first opening 11*c*, it is difficult to accurately place the compression springs 14 in the toner container 11 through the first opening 11*c*. In this embodiment, however, the toner container 11 is provided with the second opening 11*d* in addition to the first opening 11*c*, and the second opening 11*d* is positioned so that where the toner conveying member 13 and compression springs 14 are to be placed in the toner container 11 are accessible through the second opening 11*d*. That is, the developing device 10 is structured so that the toner conveying member 13 and compression springs 14 are placed on the bottom surface 11*f* of the toner container 11, as the interior of the toner container 11 is seen from the second opening side (FIG. 4(*a*)).

In other words, when the developing device 10 is assembled, the toner conveying member 13 is not between the second opening and compression springs 14. Therefore, where the compression springs 14 are to be placed can be directly accessed through the second opening 11*d*, making it easier to attach the compression springs 14. That is, even if the design of a given thin developing device is such that the compression springs 14 are behind the toner conveying member 13 as seen from the first opening side, the compression springs 14 and toner conveying member 13 can be easily installed in the toner container 11. As is evident from the detailed description of the developing device 10 in the first embodiment of the present invention, the present invention can provide a toner container 11 which is significantly thinner and easier to assemble than any developing device in accordance with the conventional art.

Further, in this embodiment, the developing device 10 is structured so that the rotational member 12 is not one of the integral parts of the toner conveying member 13, and can be placed in contact with, or separated from, the toner conveying member 13. Thus, the compression springs 14 and toner conveying member 13 can be installed when there is a gap between the rotational member 12 and toner conveying member 13. That is, it is when there is a gap between the rotational member 12 and toner conveying member 13, and therefore, the rotational member 12 is not pressing the toner conveying member 13 that the compression springs 14 and toner conveying member 13 are to be installed. That is, in this embodiment, the toner conveying member 13 is independent from the rotational member 12 as described above, being therefore easier to install than the toner conveying member (13) of any thin process cartridge in accordance with the prior art.

Also in this embodiment, the compression springs 14 were used as the means for pressing the toner conveying member 13 toward the development roller 17. However, the developing device 10 may be structured so that the rotational member 12 is rotated in the opposite direction from the rotational direction of the rotational member 12 in this embodiment, and a tension spring is employed in place of the compression springs 14.

Further, instead of providing the rotational member 12 with the cams 12*a*, the portions of the rotational member 12, which corresponds in position to the cams 12*a*, may be bent in the form of a crank. That is, all that is necessary is that as the rotational member 12 is rotated, the toner conveying member 13 is reciprocally moved by the combination of the cams 12*a* or the like (crank), and the compression springs 14 or tension spring, and also, that the closest point to the development roller 17 in terms of the moving direction of the toner conveying member 13, which the toner conveying member 13 reaches when the member 13 is pressed by the compression springs 14 is in the sweeping range of the cam 12*a*. As the rotational member 12 is rotated, its crank-like portions also press the toner conveying member 13 rearward of the toner container 11 so that the toner conveying member 13 is reciprocally moved.

Figure 8:
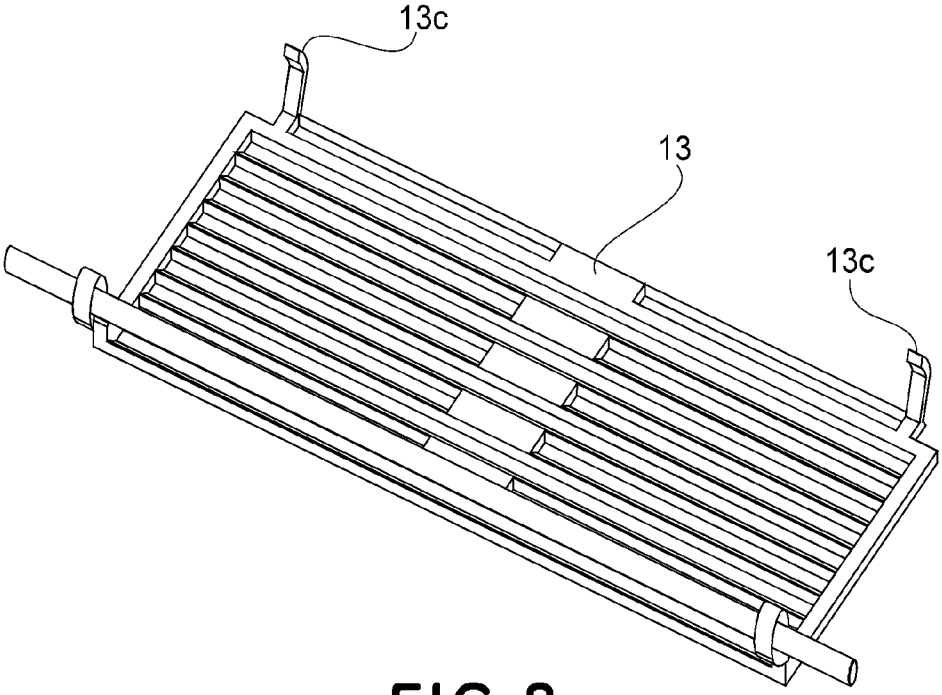
FIG. 8 is a perspective view of a toner conveying member different in design from the one in the first embodiment in that it has a pair of leaf springs instead of the pair of compression springs.

Next, referring to FIG. 8, instead of providing the developing device 10 with the compression springs 14 as the means for moving the toner conveying member 13 toward the first opening 11*c*, the toner conveying member 13 may be provided with a pair of leaf springs 13*c* (pressure applying members), or the toner container 11 may be provided with a toner conveying member pressing means which is integral with the frame of the toner container 11.

Figure 9:
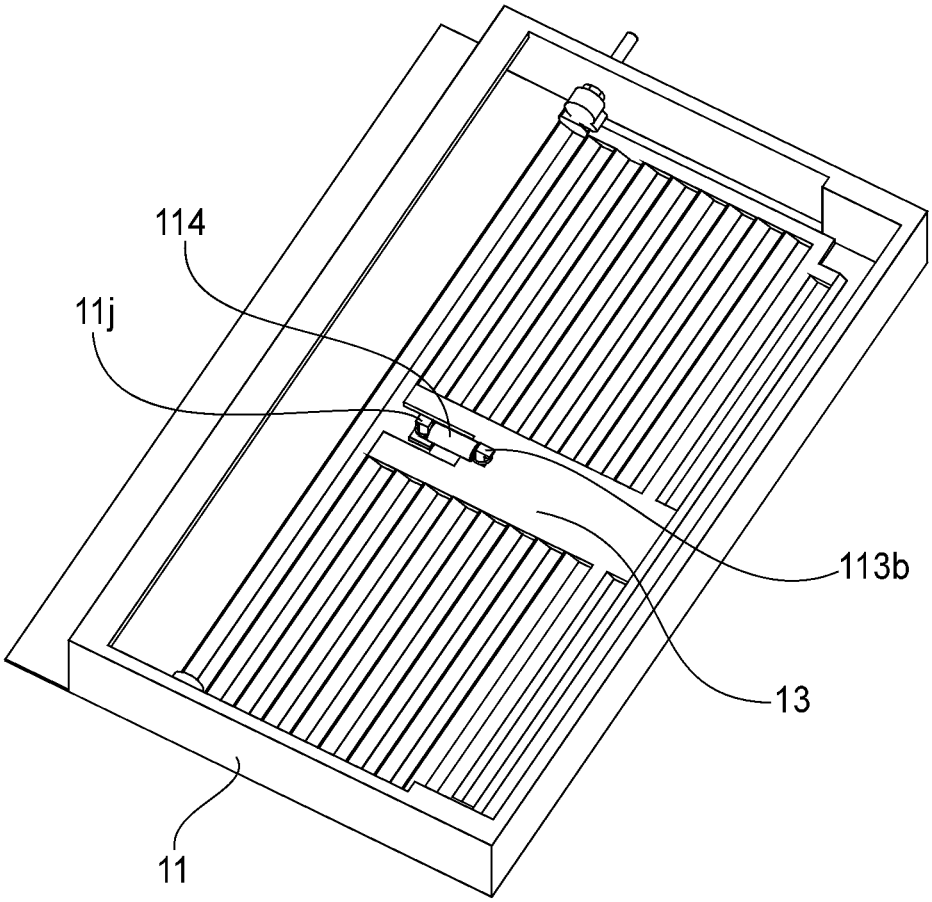
FIG. 9 is a schematic perspective view of a toner container different in design from the one in the first embodiment in that its pressure applying means is a single tension spring instead of the pair of compression springs.

Next, referring to FIG. 9, the developing device 10 may be provided with a tension spring 114 instead of the compression springs 14. In a case where the developing 10 is provided with the tension spring 114, the toner container 11 and toner conveying member 13 are provided with spring anchoring portions 11*j* and 113*b*, respectively, and the tension spring 114 is placed between the two spring anchoring portions 11*j* and 113*b*, that is, between the toner conveying member 13 and toner container 11.

Figure 10:
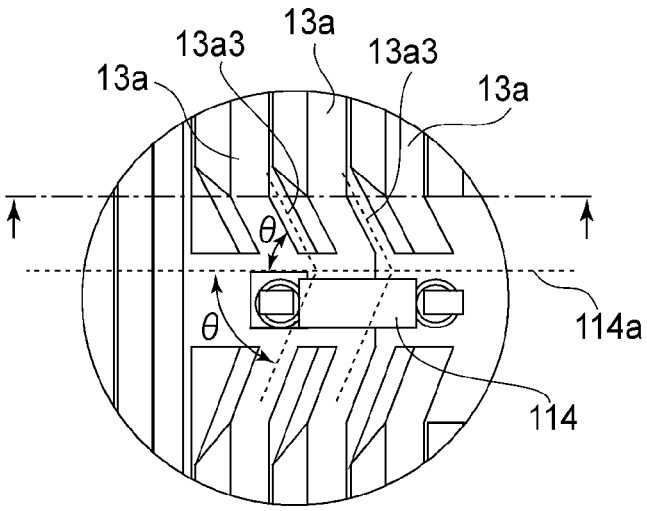
FIG. 10 is a drawing for describing a toner conveying member different in structure from the one in the first embodiment.
Figure 10:
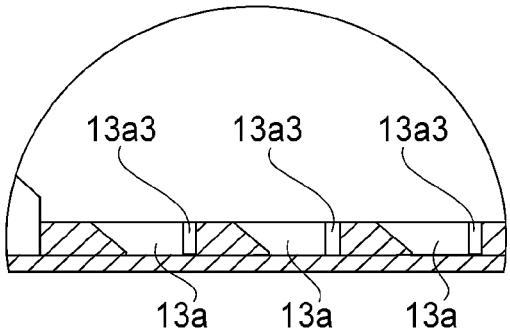
Figure 10:
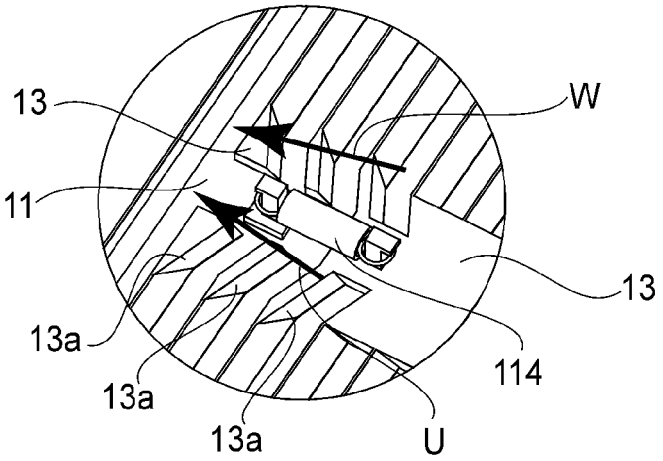
Figure 11:
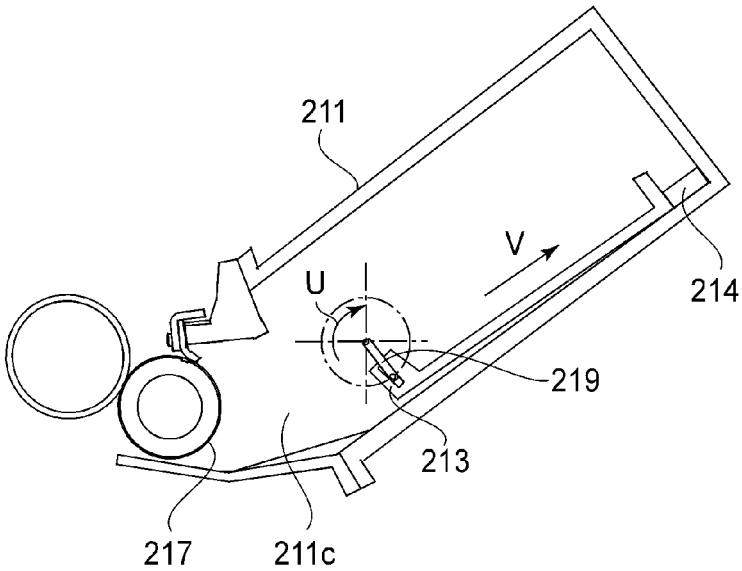
FIG. 11 is a schematic sectional view of an example of a typical thin developing device in accordance with the prior art.

In the case where the developing device 10 is provided with the tension spring 114 instead of the pair of compression springs 14, however, it is possible that the tension spring 114 will interfere with the toner conveyance by the toner conveying member 13. One of the solutions to this problem is to provide the toner conveying slats which are adjacent to the tension spring 114, with the second toner conveyance surface 13*a*3 as shown in FIGS. 10(*a*) and 10(*b*). The second toner conveyance surface 13*a*3 is roughly perpendicular to the bottom surface 11*f* of the toner chamber 11*b* (FIG. 3). More specifically, the toner conveyance slat is formed so that the angle θ between the axial line 114*a* (straight line) of the cylindrical portion of the tension spring 114 and the toner conveyance surface 13*a*3 becomes acute. Thus, as the toner conveying member 13 is made to shuttle, the toner in the adjacencies of the tension springs 114 is conveyed in the direction indicated by a pair of arrow marks in FIG. 10(*c*), by the toner conveyance surfaces 13*a*3.

That is, the toner conveyance surfaces 13*a*3 are in the adjacencies of the tension spring 114, and diagonally face the tension spring 114. Further, they are acutely angled relative to the direction in which the tension spring 114 pulls the toner conveying member 13 (which is opposite to direction in which spring 114 is extended). Therefore, the toner conveyance surfaces 13*a*3 convey the toner in the direction of where toner would not be conveyed without these surfaces 13*a*3.

Even in a case where the leaf springs 13*c* or tension spring 114 are employed in place of the compression springs 14 as the pressure applying means, this embodiment of the present invention allows the pressure applying members and toner conveying member 13 to be installed into the toner container 11 through the second opening 11*d*, making the process cartridge (developing device 10) in this embodiment easier in terms of the installation of the pressure applying members and toner conveying member 13 than any thin process cartridge (developing device 10) in accordance with the prior art. In other words, the present invention can make it easier to assembly the toner container 11, that is, a thin toner container, and afford more latitude in the choice of the structural arrangement for conveying toner in the toner container 11.

Figure 12:
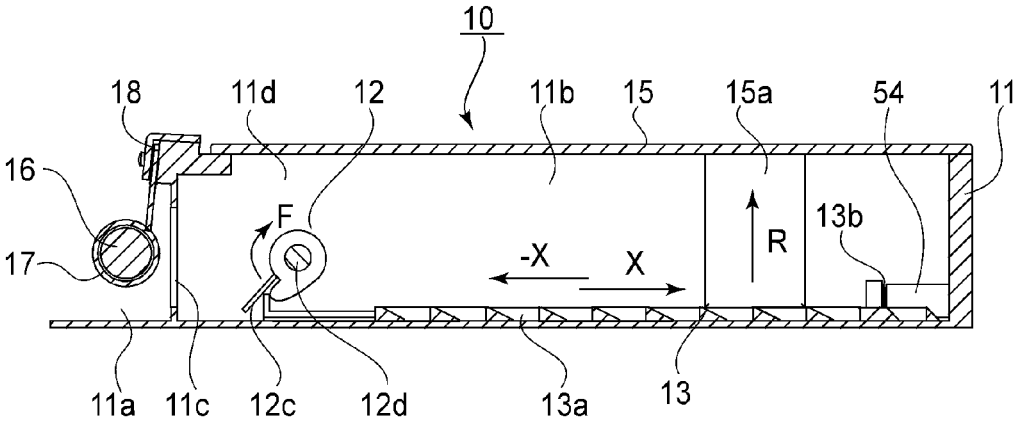
FIG. 12 is a schematic sectional view of one of the modified version of the developing device in the first embodiment, and is for describing the toner stirring portion of its rotational member.

Lastly, referring to FIG. 12, the rotational member 12 may be provided with a toner stirring portion 12*c*. The toner stirring portion 12 is a sheet of a desired choice of substance and is to be attached to the shaft 12*d* of the rotational member 12. Thus, as the rotational member 12 is rotated, the toner stirring portion 12*d* stirs the developer in the adjacencies of the first opening 11*c*. In the case of the toner container 11 shown in FIG. 12, it is a tension spring 54 instead of the compression springs 14 that is attached to the toner conveying member 13. The tension spring 54 pulls the toner conveying member 13 in the direction indicated by an arrow mark X in FIG. 12. Thus, as the rotational member 12 is rotated in the direction indicated by an arrow mark F, it presses the toner conveying member 13 in the direction indicated by an arrow mark −X. Therefore, each time the rotational member 12 is rotated one full turn, it moves the toner conveying member 13 in the direction of the arrow mark −X against the resiliency of the tension spring 54. Further, each time the rotational member 12 is rotated one full turn, it supplies the development roller 17 with the toner, by its stirring portion 12*c*. In other words, the rotational member 12 doubles as a toner stirring member, making it unnecessary to provide the toner container 11 with a member dedicated to the stirring of the toner. That is, this embodiment of the present invention makes it easier to assembly a thin toner container than the preceding embodiment of the present invention.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 2010-291708 and 2011-249456 filed Dec. 28, 2010 and Nov. 15, 2011 which are hereby incorporated by reference.

What is claimed is:

1. A developing device usable with an image forming apparatus, said developing device comprising:

a developing roller for developing an electrostatic latent image formed on a photosensitive drum using toner;

a toner container for accommodating the toner;

an opening, provided in said toner container, for supplying the toner to said developing roller;

a toner feeding member having feeding surfaces for feeding the toner to said opening;

an urging member for urging said toner feeding member; and a movable member movable between a position for moving said toner feeding member against an urging force of said urging member and a position for permitting said toner feeding member to move by the urging force of said urging member, wherein a region between said urging member and said opening is a region in which said toner feeding member is not provided with said feeding surfaces, said feeding surfaces are provided at opposite sides of said urging member with respect to an axial direction of said developing roller, and said feeding surfaces are inclined relative to a movement direction of said feeding member to feed the toner to said region not provided with said feeding surfaces.

2. A device according to claim 1, wherein said movable member is rotatable.

3. A device according to claim 2, wherein said movable member is provided with a stirring portion for stirring the toner.

4. A device according to claim 1, wherein said toner feeding member includes:

a retaining portion for retaining the toner; and an inclined surface, inclined toward a moving direction of said toner feeding member, for permitting movement of the toner to said retaining portion when said toner feeding member moves away from said opening.

5. A process cartridge detachably mountable to an image forming apparatus, said process cartridge comprising:

a photosensitive drum for bearing an electrostatic latent image;

a developing roller for developing the electrostatic latent image using toner;

a toner container for accommodating the toner;

an opening, provided in said toner container, for supplying the toner to said developing roller;

a toner feeding member having feeding surfaces for feeding the toner to said opening;

an urging member for urging said toner feeding member; and a movable member movable between a position for moving said toner feeding member against an urging force of said urging member and a position for permitting said toner feeding member to move by the urging force of said urging member, wherein a region between said urging member and said opening is a region in which said toner feeding member is not provided with said feeding surfaces, said feeding surfaces are provided at opposite sides of said urging member with respect to an axial direction of said developing roller, and said feeding surfaces are inclined relative to a movement direction of said feeding member to feed the toner to said region not provided with said feeding surfaces.

6. A process cartridge according to claim 5, wherein said movable member is rotatable.

7. A process cartridge according to claim 6, wherein said movable member is provided with a stirring portion for stirring the toner.

8. A process cartridge according to claim 5, wherein said toner feeding member includes:

a retaining portion for retaining the toner; and an inclined surface, inclined toward a moving direction of said toner feeding member, for permitting movement of the toner to said retaining portion when said toner feeding member moves away from said opening.

9. A toner container for accommodating toner, said toner container comprising:

a first opening through which the toner is passable;

a toner feeding member for feeding the toner to said first opening by reciprocating motion toward and away from said first opening;

an urging member for urging said toner feeding member;

a movable member movable between a position for moving said toner feeding member against an urging force of said urging member and a position for permitting said toner feeding member to move by the urging force of said urging member;

a second opening, provided in said toner container, for permitting said urging member and said toner feeding member to pass into said toner container to install said urging member and said toner feeding member in said toner container; and a cover for closing said second opening, wherein said toner feeding member makes reciprocating motion while contacting a bottom portion of said toner container as seen through said second opening into said toner container, and wherein said cover is provided with a preventing portion protruding from said cover, and said preventing portion is capable of preventing said toner feeding member from becoming spaced from said bottom portion of said toner container beyond a predetermined distance by contacting said toner feeding member.

10. A toner container according to claim 9, wherein said urging member is disposed in a rear side of said toner feeding member as seen through said second opening into said toner container.

11. A developing device usable with an image forming apparatus, said developing device comprising:

a developing roller for developing an electrostatic latent image formed on a photosensitive drum using toner;

a toner container for accommodating the toner;

a first opening, provided in said toner container, for supplying the toner to said developing roller;

a toner feeding member for feeding the toner to said first opening by reciprocating motion toward and away from said first opening;

an urging member for urging said toner feeding member;

a movable member movable between a position for movie said toner feeding member against an urging force of said urging member and a position for permitting said toner feeding member to move by the urging force of said urging member;

a second opening, provided in said toner container, for permitting said urging member and said toner feeding member to pass into said toner container to install said urging member and said toner feeding member in said toner container; and a cover for closing said second opening, wherein said toner feeding member makes reciprocating motion while contacting a bottom portion of said toner container as seen through said second opening into said toner container, and wherein said cover is provided with a preventing portion protruding from said cover, said preventing portion being capable of preventing said toner feeding member from becoming spaced from said bottom portion of said toner container beyond a predetermined distance by contacting said toner feeding member.

12. A device according to claim 11, wherein said urging member is disposed in a rear side of said toner feeding member as seen through said second opening into said toner container.

13. A process cartridge detachably mountable to an image forming apparatus, said process cartridge comprising:

a photosensitive drum for bearing an electrostatic latent image;

a developing roller for developing the electrostatic latent image using toner;

a toner container for accommodating the toner;

a first opening, provided in said toner container, for supplying the toner to said developing roller;

a toner feeding member for feeding the toner to said first opening by reciprocating motion toward and away from said first opening;

an urging member for urging said toner feeding member;

a movable member movable between a position for moving said toner feeding member against an urging force of said urging member and a position for permitting said toner feeding member to move by the urging force of said urging member;

a second opening, provided in said toner container, for permitting said urging member and said toner feeding member to pass into said toner container to install said urging member and said toner feeding member in said toner container; and a cover for closing said second opening, wherein said toner feeding member makes reciprocating motion while contacting a bottom portion of said toner container as seen through said second opening into said toner container, and wherein said cover is provided with a preventing portion protruding from said cover, said preventing portion being capable of preventing said toner feeding member from becoming spaced from said bottom surface of said toner container beyond a predetermined distance by contacting said toner feeding member.

14. A process cartridge according to claim 13, wherein said cover is provided with a preventing portion for preventing said toner feeding member from departing from an inside of said toner container.

15. A process cartridge according to claim 13, wherein said toner feeding member is installed on a bottom portion of said toner container as seen through said second opening into said toner container.

16. A process cartridge according to claim 13, wherein said urging member is disposed in a rear side of said toner feeding member as seen through said second opening into said toner container.

* * * * *